US010659895B2

(12) United States Patent
Nomoto et al.

(10) Patent No.: US 10,659,895 B2
(45) Date of Patent: May 19, 2020

(54) FAILURE DETECTION APPARATUS, AUDIO INPUT/OUTPUT MODULE, EMERGENCY NOTIFICATION MODULE, AND FAILURE DETECTION METHOD

(71) Applicant: YAMAHA CORPORATION, Hamamatsu-shi (JP)

(72) Inventors: Kentaro Nomoto, Hamamatsu (JP); Masahiro Mukojima, Fukuroi (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/057,107

(22) Filed: Aug. 7, 2018

(65) Prior Publication Data

US 2018/0343531 A1 Nov. 29, 2018

Related U.S. Application Data

(63) Continuation of application No. PCT/JP2016/080602, filed on Oct. 14, 2016.

(51) Int. Cl.

| | |
|---|---|
| ***H04R 29/00*** | (2006.01) |
| ***G08B 29/12*** | (2006.01) |
| ***H04R 1/40*** | (2006.01) |
| ***H04R 3/04*** | (2006.01) |

(Continued)

(52) U.S. Cl.

CPC ..... *H04R 29/004* (2013.01); *G08B 25/08* (2013.01); *G08B 29/12* (2013.01); *H04R 1/406* (2013.01); *H04R 3/04* (2013.01); *H04R 27/00* (2013.01); *H04R 29/00* (2013.01)

(58) Field of Classification Search

CPC .... H04R 29/00; H04R 29/001; H04R 29/004; H04R 29/005; H04R 1/406; H04R 3/04; H04R 27/00; G08B 25/08; G08B 29/12

See application file for complete search history.

(56) References Cited

U.S. PATENT DOCUMENTS

| | | | | |
|---|---|---|---|---|
| 4,037,222 | A | 7/1977 | Solomon | |
| 9,332,366 | B2 | 5/2016 | Wu | |
| 9,454,893 | B1 * | 9/2016 | Warren | G08B 29/10 |

(Continued)

FOREIGN PATENT DOCUMENTS

| | | | |
|---|---|---|---|
| CN | 104168532 | A | 11/2014 |
| CN | 204667145 | U | 9/2015 |

(Continued)

OTHER PUBLICATIONS

International Search Report issued in Intl. Appln. No. PCT/JP2016/080602 dated Jan. 10, 2017. English translation provided.

(Continued)

*Primary Examiner* — Jason R Kurr

(74) *Attorney, Agent, or Firm* — Rossi, Kimms & McDowell LLP

(57) ABSTRACT

A failure detection apparatus includes: an output portion that outputs from an audio output device a confirmation signal having a frequency in a band other than the audible band; an input portion to which an input signal is inputted from an audio input device; and a failure detection portion that detects whether the audio output device and the audio input device are operating normally on the basis of the confirmation signal and the input signal.

10 Claims, 6 Drawing Sheets

(51) Int. Cl.
*H04R 27/00* (2006.01)
*G08B 25/08* (2006.01)

(56) References Cited

U.S. PATENT DOCUMENTS

2007/0030978 A1* 2/2007 Kino ..... G01H 5/00 381/56
2009/0304195 A1* 12/2009 Fillol ..... H04R 29/007 381/59
2010/0019781 A1* 1/2010 Woelfl ..... H04R 3/00 324/691
2012/0286946 A1* 11/2012 Karl ..... G08B 29/126 340/516
2014/0340215 A1* 11/2014 Piccolo, III ..... G08B 29/12 340/514
2015/0139430 A1* 5/2015 Miyata ..... H04R 29/002 381/56
2018/0089987 A1 3/2018 Hosoi
2018/0096589 A1* 4/2018 Lynch ..... G08B 1/08

FOREIGN PATENT DOCUMENTS

JP H05328499 A 12/1993
JP 3775233 B2 5/2006
JP 2014068066 A 4/2014
JP 2016032260 A 3/2016
JP 2017212687 A 11/2017
WO 2016088323 A1 6/2016

OTHER PUBLICATIONS

Written Opinion issued in Intl. Appln. No. PCT/JP2016/080602 dated Jan. 10, 2017.
Office Action issued in Chinese Appln. No. 201680081030.7 dated Dec. 4, 2019. English translation provided.
Extended European Search Report issued in European Appln. No. 16918986.7 dated Nov. 5, 2019.
Office Action issued in Japanese Appln. No. 2018-206911 dated Feb. 4, 2020. English machine translation provided.

* cited by examiner

FAILURE DETECTION APPARATUS, AUDIO INPUT/OUTPUT MODULE, EMERGENCY NOTIFICATION MODULE, AND FAILURE DETECTION METHOD

PRIORITY CLAIM

This application is continuation application of a PCT Application No. PCT/JP2016/080602, filed on Oct. 14, 2016, entitled "FAILURE DETECTION APPARATUS, AUDIO INPUT/OUTPUT MODULE, EMERGENCY NOTIFICATION MODULE, AND FAILURE DETECTION METHOD"

BACKGROUND OF THE INVENTION

Field of the Invention

The present invention relates to a failure detection apparatus, an audio input/output module, an emergency notification module, and a failure detection method.

Description of Related Art

In an apparatus that performs notification during an emergency, there is conventionally known a method of detecting an abnormality such as failure of the apparatus (for example, see Japanese Patent No. 3775233). The emergency information notification apparatus described in Japanese Patent No. 3775233 emits a predetermined sound signal in the audible band such as a start-up message from a speaker when the apparatus starts up, which informs the user of the startup. The emergency information notification apparatus also performs abnormality diagnosis of the emergency information notification apparatus by detecting/analyzing a loop-back signal obtained by inputting the emitted predetermined sound signal from a microphone.

However, in the emergency information notification apparatus disclosed in Japanese Patent No. 3775233, abnormality diagnosis is performed only at startup. For this reason, even if an abnormality is not found at the time of startup, if the emergency information notification apparatus fails afterwards, it is impossible to report emergency information. In addition, if abnormality diagnosis is repeatedly performed continuously after startup, the predetermined sound signal in the audible band is emitted at each abnormality diagnosis. It is preferable that the predetermined sound signal in the audible band be emitted as infrequently as possible.

SUMMARY OF THE INVENTION

The present invention has been made in view of the above circumstances. An object of the present invention is to provide a failure detection apparatus, an audio input/output module, an emergency notification module and a failure detection method, capable of performing failure detection while suppressing the emission of sounds having a frequency in the audible band.

In order to solve the above-mentioned problems, the failure detection apparatus of the present invention includes an output portion that causes a confirmation signal having a frequency in a band other than the audible band to be output from an audio output device; an input portion to which an input signal is inputted from an audio input device; and a failure detection portion that detects whether the audio output device and the audio input device are operating normally on the basis of the confirmation signal and the input signal.

The failure detection method of the present invention includes an output step that causes a confirmation signal having a frequency in a band other than the audible band to be output from an audio output device; an input step that inputs an input signal from an audio input device; and a detection step that detects whether the audio output device and the audio input device are operating normally on the basis of the confirmation signal and the input signal.

EMBODIMENTS FOR CARRYING OUT THE INVENTION

Figure 1:
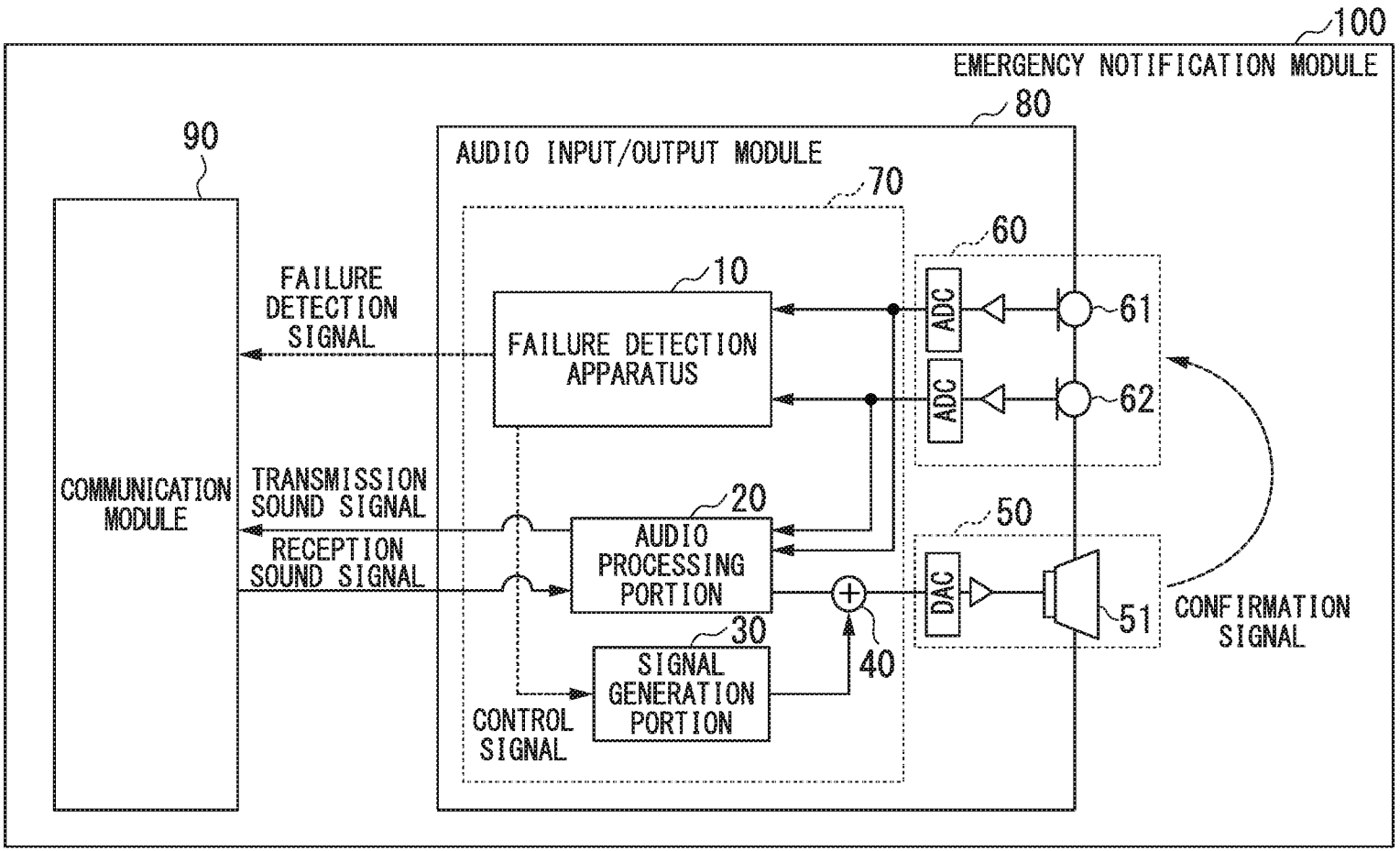
FIG. 1 is a function block diagram showing an example of the emergency notification module according to an embodiment of the present invention.

Hereinbelow, a failure detection apparatus according to an embodiment of the present invention will be described with reference to the drawings. FIG. 1 is a function block diagram showing an example of an emergency notification module using the failure detection apparatus according to the embodiment of the present invention. For example, the emergency notification module 100 is installed in the cabin of a vehicle or the like, and performs emergency notification during an emergency such as the occurrence of an accident. In the present embodiment, the emergency notification module 100 is provided with a communication module 90 and an audio input/output module 80.

The communication module 90 is provided with a radio transceiver (not shown) and communicates with an emergency center or the like via the radio transceiver. The communication module 90 inputs a transmission sound signal such as an emergency notification from the user that is output from the audio input/output module 80, and transmits the transmission sound signal to the emergency center or the like. The communication module 90 receives a reception sound signal such as a response to the emergency notification output from an emergency center or the like, and outputs the reception sound signal to the audio input/output module 80.

In addition, the communication module 90 inputs a failure detection signal outputted from the audio input/output module 80 and transmits a failure detection signal to the emergency center or the like.

The audio input/output module 80 is provided with an audio output device 50, an audio input device 60, and a processor 70. The audio output device 50 is provided with a DAC (Digital Analog Converter), an amplifier, and a speaker. The audio input device 60 is provided with microphones 61 and 62, an amplifier, and an analog-digital converter (ADC). The processor 70 is provided with a failure detection apparatus 10, an audio processing portion 20, a signal generation portion 30, and an adder 40.

Each of the failure detection apparatus 10, the audio processing portion 20, the signal generation portion 30, and the adder 40 is, for example, a CPU (Central Processing Unit), a DSP (Digital Signal Processor), or a processor that is a combination thereof, and realized by the execution of a program (software) stored in program memory. Some or all of the functions executed by these programs may be realized by an analog control circuit or hardware such as LSI (Large Scale Integration), ASIC (Application Specific Integrated Circuit), FPGA (Field Programmable Gate Array), or may be realized through the collaboration of software and hardware.

By outputting a control signal, the failure detection apparatus 10 causes the signal generation portion 30 to generate a confirmation signal having frequencies in a band other than the audible band. The confirmation signal is emitted (output) as a sound from the audio output device 50 via the adder 40. Also, the confirmation signal that is output loops around to the audio input device 60 via the space inside the vehicle cabin, and is picked up (input) by the audio input device 60 as an input signal.

The failure detection apparatus 10 inputs the input signal from the audio input device 60. In addition, the failure detection apparatus 10 detects whether or not the audio output device 50 and the audio input device 60 operate normally, on the basis of the confirmation signal and the input signal.

The audio processing portion 20 inputs the received sound signal from the communication module 90 and outputs the reception sound signal to the audio output device 50 via the adder 40. The audio processing portion 20 inputs an input signal from the audio input device 60, performs audio processing on the input signal, and outputs the input signal after audio processing (transmission sound signal) to the communication module 90.

The signal generation portion 30 generates a signal having a predetermined frequency according to a control signal from the failure detection apparatus 10. The signal generation portion 30 uses, for example, a pulse generator or DTMF (Dual Tone Multi-Frequency) generator to generate a signal having a predetermined frequency. In the case of using DTMF, for example, the signal generation portion 30 generates the signal having a predetermined frequency selected from among eight predetermined frequencies (tone signals) between 697 and 1633 Hz in the DTMF generator, and by performing signal processing using the double-angle formula shown in Equation (1) and the triple-angle formula shown in Equation (2) below on the tone signal, can generate a signal having a predetermined frequency. Here, x indicates an arbitrary angle.

$$\mathrm{Cos}(2x)=1-2\times\{\mathrm{Sin}(x)\}^2 \quad (1)$$

$$\mathrm{Sin}(3x)=3x\ \mathrm{Sin}(x)-4\times\{\mathrm{Sin}(x)\}^3 \quad (2)$$

For example, the signal generation portion 30 generates a tone signal of 697 Hz in DTMF, and then can generate a signal having a frequency of 2091 Hz by multiplying the tone signal by 3 based on the above Equation (2).

In accordance with the control signal from the failure detection apparatus 10, the signal generation portion 30 adjusts the signal level of the generated signal having the predetermined frequency, and generates a confirmation signal.

The adder 40 adds the reception sound signal from the audio processing portion 20 and the confirmation signal from the signal generation portion 30, and outputs the summed signal to the audio output device 50.

The audio output device 50 converts the digital signal from the adder 40 into an analog signal by the DAC and outputs the converted analog signal to the speaker 51 via a buffer such as an amplifier. The speaker 51 converts the electrical signal from the amplifier into physical vibrations and outputs the physical vibrations to the outside.

The audio input device 60 converts the vibration amplitude of external sound or the sound output from the audio output device 50 into an analog electrical signal by the microphones 61 and 62, converts the converted analog electric signal into a digital signal by the ADC, and outputs the digital signal obtained by the conversion to the failure detection apparatus 10 and the audio processing portion 20.

Figure 2:
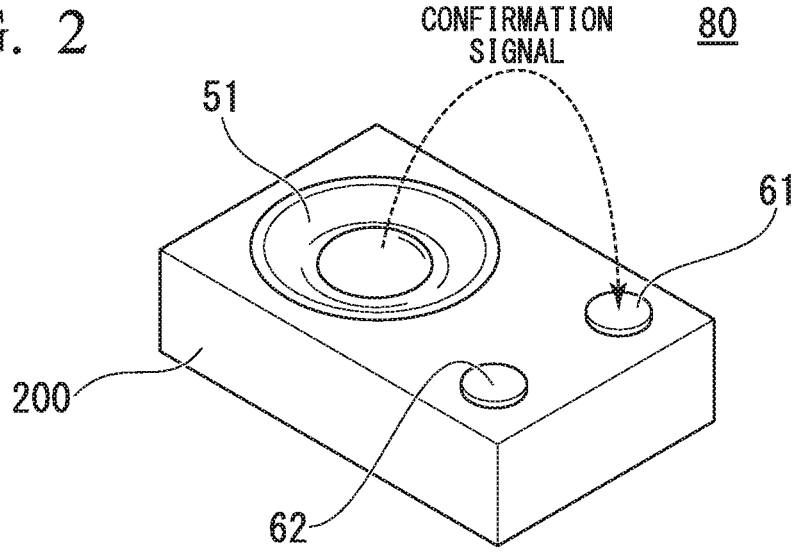
FIG. 2 is a perspective view showing an audio input/output module according to the embodiment of the present invention.

FIG. 2 is a perspective view showing an example of the audio input/output module 80. In the example shown in FIG. 2, the speaker 51 is installed at the center of a main surface of a housing 200. The microphone 61 is installed at one of the adjacent top portions of the main surface of the housing 200 and the microphone 62 at the other so that the distances from the speaker 51 are equal to each other. By arranging the distances to be equal to each other in this way, the confirmation signal output from the speaker 51 can be input to the microphones 61 and 62 at substantially the same sound pressure level.

As shown in FIG. 2, the confirmation signal output from the speaker 51 loops around to the microphones 61 and 62 to be input from the microphones 61 and 62. The failure detection apparatus 10 causes the signal generation portion 30 to adjust the signal level of the confirmation signal so that the sound pressure at the microphones 61 and 62 when the confirmation signal loops around and is input to the microphones 61 and 62 becomes, for example, 70 dB SPL (Sound Pressure Level) on average.

When mounting in the cabin of a vehicle, this kind of audio input/output module 80 may be mounted at any position on the ceiling between the driver's seat and the passenger seat. In this case, since the confirmation signal outputted from the speaker 51 is emitted toward the space between occupants of the driver's seat and the passenger seat, it can be made less prone to enter the ears of the driver and the passenger.

In addition, the audio processing performed by the audio processing portion 20 includes processing for preventing howling and the like from being included in the input signal. Howling occurs when the sound output from the audio output device 50 loops around to the audio input device 60 and is input from the audio input device 60 together with external sound. In the present embodiment, the microphone 61 and the microphone 62 are installed such that the distances thereto from the speaker 51 are equal to each other. Thereby the sound that is obtained by the sound output from the speaker 51, including the confirmation signal component, looping around and being inputted to the audio input device 60 is equally inputted to the microphone 61 and the microphone 62. Therefore, the audio processing unit 20, by subtracting from one input signal the other input signal with respect to the input signal from the microphone 61 of the audio input device 60 and the input signal from the microphone 62, can remove sound that results from sound outputted from the audio output device 50 including the confirmation signal component looping around to the audio input device 60 and being input, and thereby prevent howling. By preventing the howling from occurring by the audio processing portion 20, it is possible to suppress a decrease in sound quality of the transmission sound signal.

Figure 3:
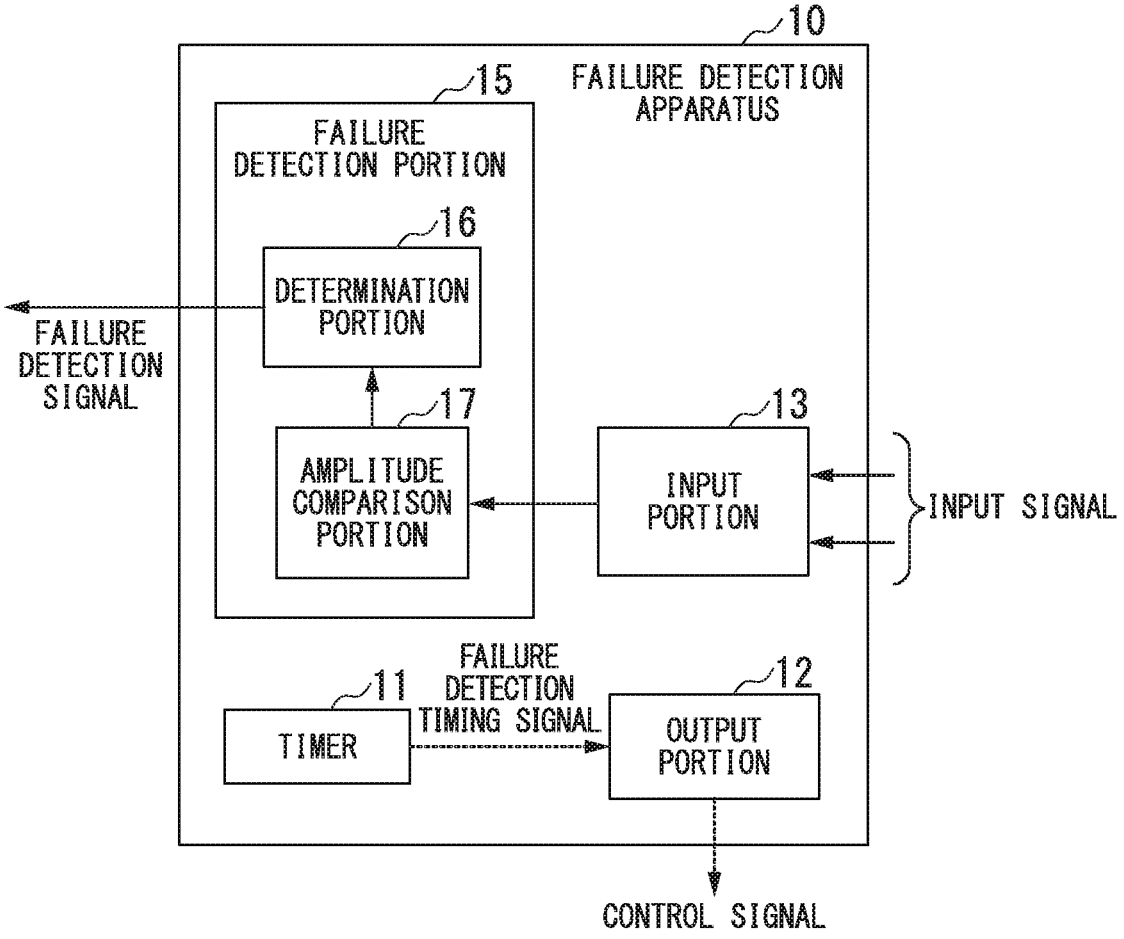
FIG. 3 is a function block diagram showing an example of a failure detection apparatus.

FIG. 3 is a diagram showing an example of the failure detection apparatus 10. The failure detection apparatus 10 is provided with a timer 11, an output portion 12, an input portion 13, and a failure detection portion 15. The failure detection apparatus 10 for example receives a failure detection timing signal output from the timer 11 at an arbitrary timing, performs a failure detection process, and outputs the detection result as a failure detection signal. The arbitrary timing referred to here may be any timing after startup, and may for example be a timing of a periodic time after startup. In this way, since the failure detection processing can be performed at an arbitrary timing, the failure detection processing can be performed even at times other than startup.

The output portion 12 causes the signal generation portion to generate a confirmation signal composed of a frequency in a band other than the audible band. Here, the audible band is a band of frequencies that a person can perceive as sound due to tympanic membrane vibration or the like, and generally refers to a frequency band of about 20 Hz to 20 kHz. However, individual differences and age differences are large with respect to whether a frequency is perceived as sound. In the present embodiment, the confirmation signal composed of a frequency in a band other than the audible band means a signal composed of frequencies which are generally difficult to be perceived by the human auditory system. A signal composed of a frequency in the audible band may be included in a portion of the confirmation signal to the extent of being difficult to be perceived by the human auditory system.

Here, the frequency of the confirmation signal will be described. While the confirmation signal should be a signal having a frequency higher than about 20 kHz, it is preferably a frequency that can be output from the audio output device 50 and a frequency that can be input from the audio input device 60.

Output devices such as speakers and input devices such as microphones are devices that generally output and input sound signals in the audible range. For this reason, the signal should be expressible up to about 20 kHz, and the sampling frequency generally processed by these devices is often around 48 kHz, or multiples thereof such as about 96 kHz or about 192 kHz.

In addition, it is generally known that signals with lower frequencies (longer wavelengths) are easier to loop around, while signals with higher frequencies (smaller wavelengths) have greater linearity and therefore less easily loop around. In the present embodiment, in order for the confirmation signal to be input to the audio input device 60, it is preferable that the frequency be such that the linearity not be so high (for example, 100 kHz or less).

Further, in the present embodiment, it is preferable that the confirmation signal be a signal without signal distortion. In order not to generate signal distortion in the confirmation signal, it is desirable to perform processing to generate a confirmation signal at a sampling frequency of about four times or more the frequency of the confirmation signal. By suppressing signal distortion in the confirmation signal output from the audio output device 50, it is possible to reduce the output of a signal in the audible band caused by the signal distortion.

From the perspective described above, it is desirable that a confirmation signal be constituted at a frequency that can be input and output by a general-purpose audio input/output device, loops around adequately, and has low distortion. In the failure detection apparatus of the present embodiment, it is assumed that the confirmation signal is composed of a frequency of 16 to 24 kHz.

Figure 4A:
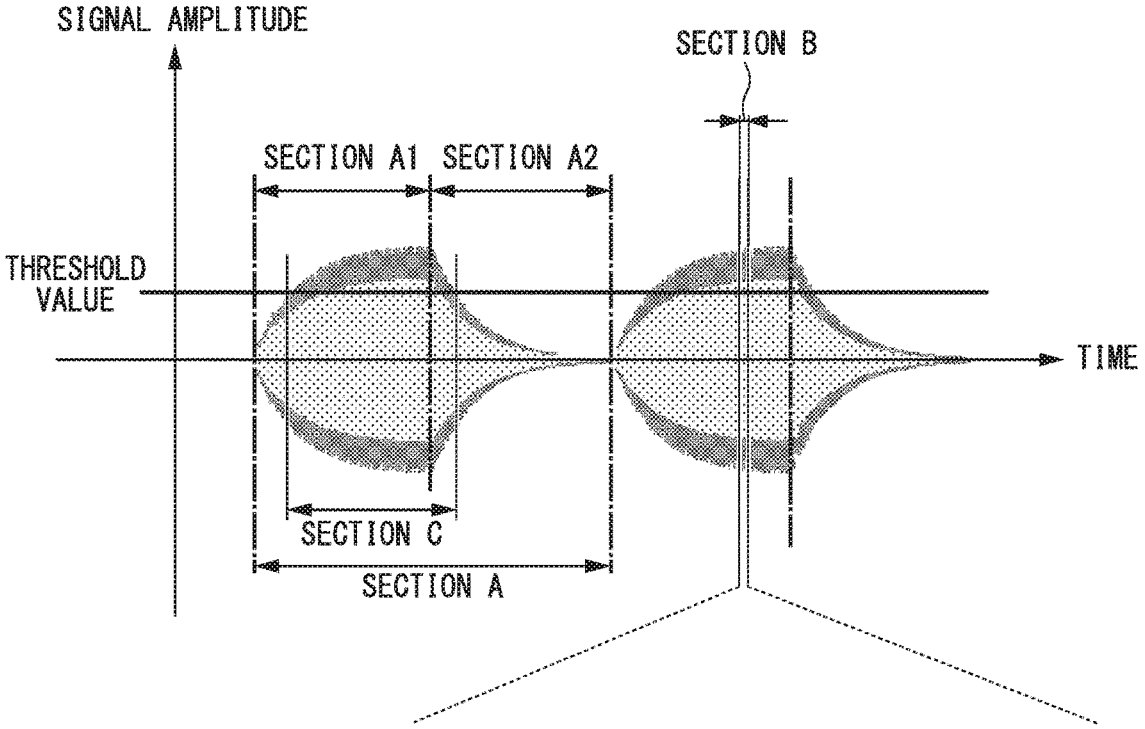
FIGS. 4A and 4B are drawings showing a confirmation signal.
Figure 4B:
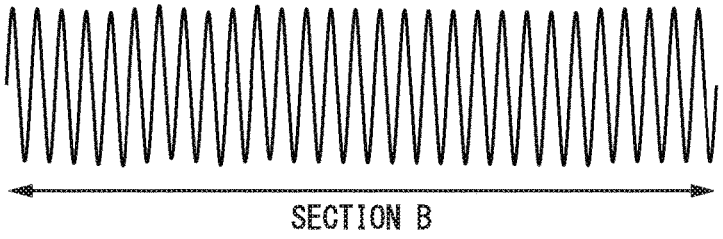

FIGS. 4A and 4B are diagrams for explaining the confirmation signal. FIG. 4A is a diagram showing an example of a confirmation signal. FIG. 4B is an enlarged view of a portion of the confirmation signal. In FIG. 4A, the vertical axis represents signal amplitude and the horizontal axis represents time.

As shown in FIG. 4A, the confirmation signal is, for example, a burst signal. By making the confirmation signal a burst signal, in the case of naturally occurring noise having a frequency constituting the confirmation signal being mixed with the confirmation signal when the confirmation signal loops around to the audio input device 60 and is inputted thereto, it is possible to easily distinguish the presence of the confirmation signal by the failure detection portion 15. The failure detection processing performed by the failure detection portion 15 will be described in detail later.

In the example of FIG. 4A, the length of section A1 is equal to the length of section A2, and the ratio (duty ratio) of the signal section (the section A1, for example 0.5 sec) to the period (section A including section A1 and section A2, for example 1 second) is about 50%. When setting the confirmation signal as a burst signal, the burst period and the duty ratio may be arbitrary. By artificially setting the burst period and the duty ratio of the confirmation signal, the failure detection apparatus 10 of the present embodiment can easily distinguish the confirmation signal from noise that is naturally present and so perform failure detection more accurately.

Here, when the duty ratio of the input signal from the audio input device 60 is within the predetermined range, the duty ratio is determined to be normal. Although the predetermined range can be arbitrarily set, the range may be set in consideration of the case of naturally present noise being included in the duty ratio that was set when generating the confirmation signal. By doing this, erroneous determination due to mixing-in of noise can be reduced.

In FIG. 4A, the envelope of the confirmation signal gradually increases during the section A1, and the envelope of the confirmation signal gradually decreases during the section A2. That is, the confirmation signal is adjusted and output so as to suppress abrupt changes of the envelope. A sudden change in the envelope distorts the signal waveform, which may be a cause of noise due to signal distortion. The failure detection apparatus 10 of the present embodiment can suppress the generation of noise in the audible band by signal distortion that occurs from switching between a signal section and a non-signal section, by adjusting the pulse width of the confirmation signal so that the envelope of the burst signal gradually changes.

Further, in FIG. 4A, a threshold value is set for the signal amplitude. In FIG. 4A, it is shown that, with respect to section A corresponding to the burst period of the confirmation signal, the section having an amplitude equal to or greater than the predetermined threshold value is section C.

Returning to FIG. 3, an input signal from the audio input device 60 is input to the input portion 13, which outputs the input signal to the failure detection portion 15. The confirmation signal that looped around to the audio input device 60 is included in the input signal. The input portion 13 may pass the input signal through a bandpass filter and output the signal that has passed through the bandpass filter to the failure detection portion 15. In this case, the bandpass filter has the property of blocking a signal having a frequency different from the frequency of the confirmation signal.

When causing the signal generation unit 30 to generate a signal, since the failure detection apparatus 10 specifies the frequency of the confirmation signal, a bandpass filter process that extracts a signal having the frequency of the confirmation signal from the input signal can be performed. By using an input signal that has passed through a bandpass filter in the failure detection process, the failure detection apparatus 10 can detect failure more accurately.

Based on the confirmation signal and the input signal, the failure detection portion 15 detects whether at least one of the audio output device 50 and the audio input device 60 is normal. The failure detection portion 15 includes an amplitude comparison portion 17 and a determination portion 16.

The amplitude comparison portion 17 compares the amplitude of the input signal and a predetermined threshold value. The amplitude comparison portion 17 notifies the comparison result to the determination portion 16.

The determination portion 16 receives the comparison result from the amplitude comparison portion 17, holds the comparison result for a predetermined time, and finds the ratio of the time with respect to the burst cycle during which the input signal is equal to or greater than the threshold value (the ratio of section C to section A in FIG. 4A, hereinbelow referred to as the section ratio).

Based on the obtained section ratio, the determination portion 16 determines that the audio output device 50 and the audio input device 60 are normal when the section ratio is within a predetermined range set in advance. When the section ratio is outside the predetermined range set in advance, the determination portion 16 determines that either one of the audio output device 50 and the audio input device 60 is not normal.

The determination unit 16 outputs the determination result as a failure detection signal.

The failure detection portion 15 may perform failure detection on an input signal obtained by summing up the signals input from both of the microphones 61 and 62 of the audio input device 60, or may perform failure detection for each of the signals input from the microphones 61 and 62, respectively.

In the case of performing failure detection with summed input signals, for example, when the signal amplitude of the summed input signals is equal to or greater than a threshold value, which corresponds to the signal amplitude value of summed input signals that have been normally input from the audio input device 60, the failure detection portion 15 can determine that the input signals have been input from both of the microphones 61 and 62. On the other hand, if the signal amplitude of the summed input signals is equal to or greater than the threshold value but does not correspond to the signal amplitude value of summed input signals that have been normally input from the microphones 61 and 62, the failure detection portion 15 can determine that the input signal from either one of the microphones 61 and 62 has been normally input, while the input signal from the other has not been normally input.

When performing individual failure detection, for example the failure detection portion 15 first causes the input portion 13 to input the signal from the microphone 61 and performs failure detection. Next, the failure detection portion 15 causes the input portion 13 to input the signal from the microphone 62 and performs failure detection. By doing so, the failure detection portion 15 can detect whether each of the microphones 61 and 62 is normal or not. For example, when either one of the microphones 61 or 62 is not normal, there is determined to be a minor failure, and when both of the microphones 61 and 62 are not normal, there is determined to be a serious failure. The failure detection portion 15 may output a failure detection signal including information expressing that the failure is a minor failure or a serious failure.

Figure 5A:
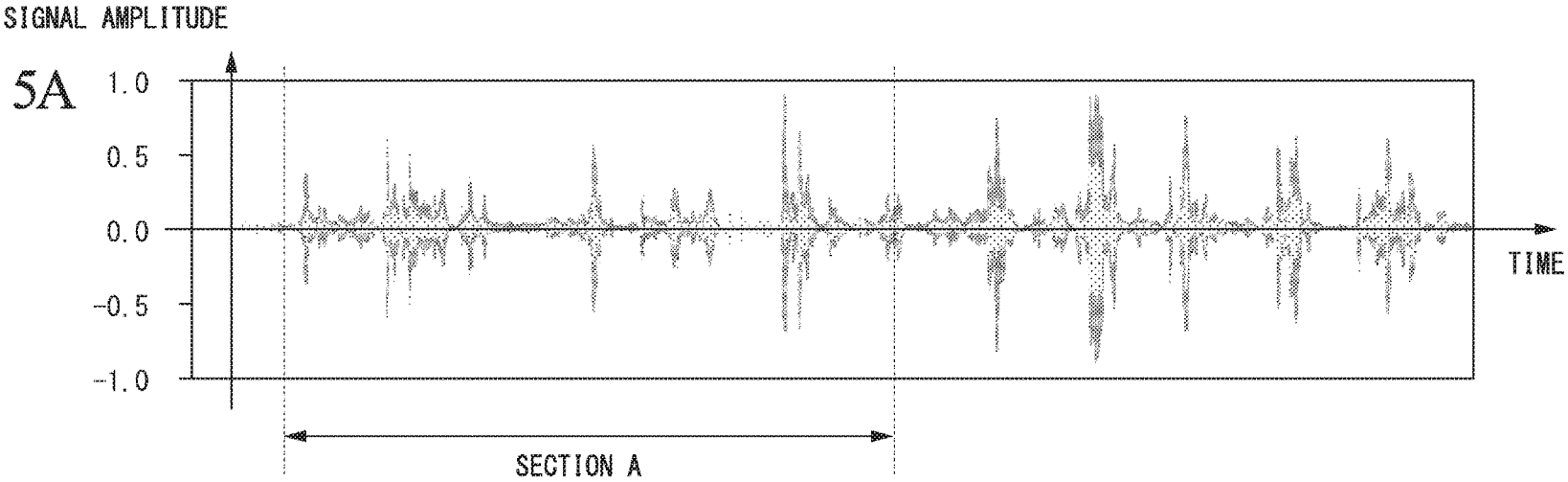
FIGS. 5A and 5B are drawings showing a relationship between an input signal and noise.
Figure 5B:
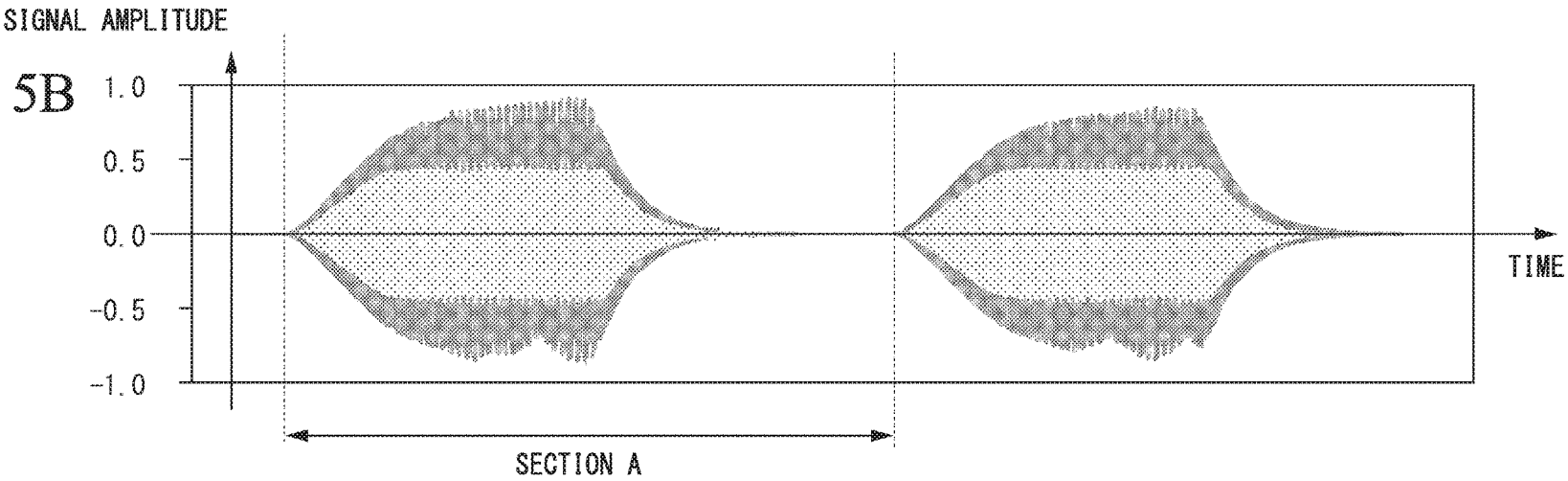

FIGS. 5A and 5B are diagrams for explaining the relationship between an input signal and noise. FIG. 5A is a diagram showing an example of a waveform of noise existing in the environment, with the noise having a frequency close to the frequency constituting the confirmation signal. For example, it is a waveform of noise generated when a metal object such as a metal key holder strikes another metal object. FIG. 5B is a diagram showing an example of the waveform of the input signal. Even when using an input signal passed through a bandpass filter in the failure detection processing, noise having a frequency close to the frequency constituting the confirmation signal cannot be removed. For this reason, sometimes noise becomes mixed with the confirmation signal in the input signal. Even in such a case, by setting the burst period of the confirmation signal to be distinguishable from the continuation time of noise occurrence (for example, by setting the burst period to be longer than the continuation time of noise occurrence), it is possible to more accurately determine the presence or absence of the confirmation signal included in the input signal.

Figure 6:
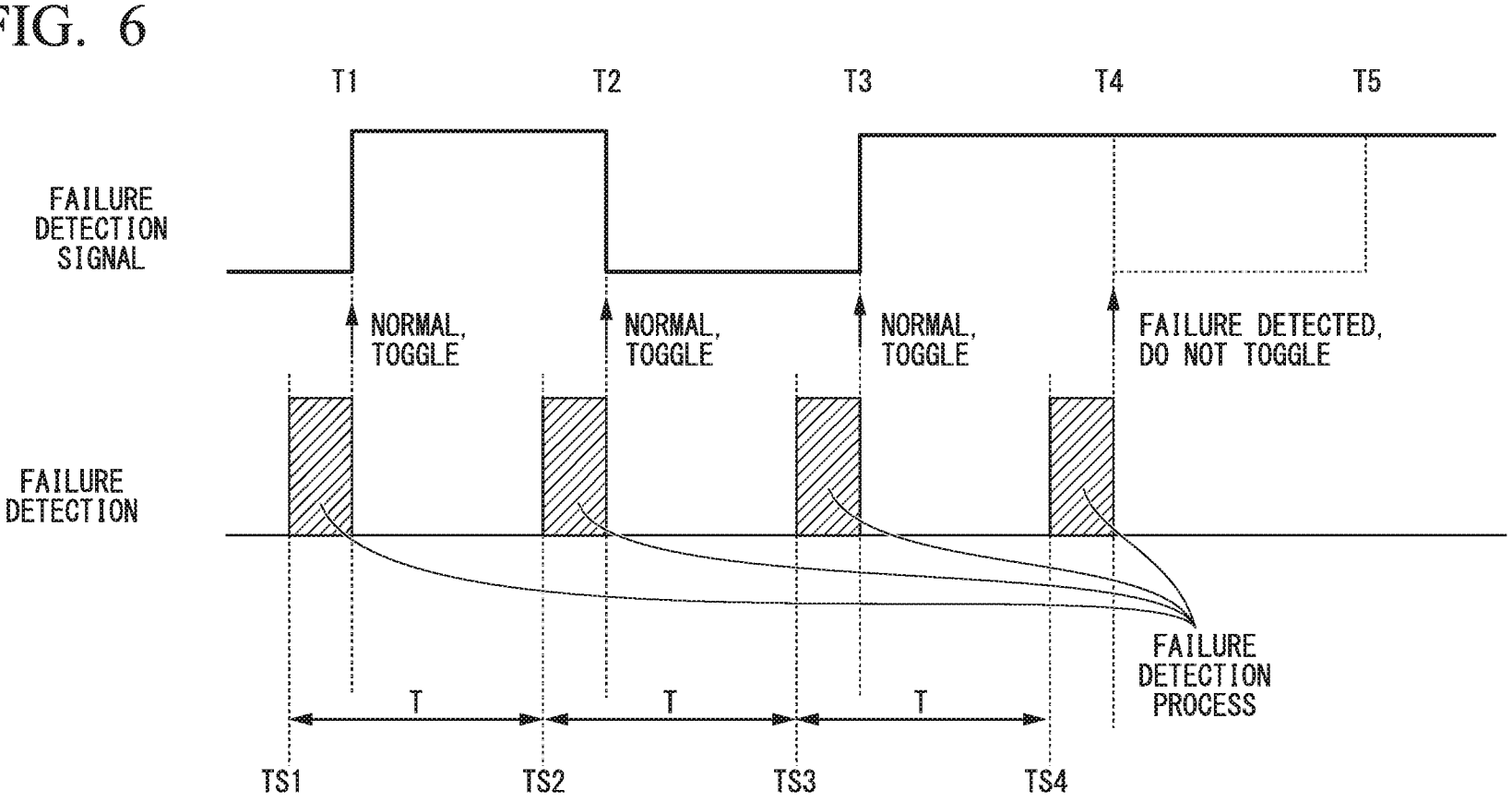
FIG. 6 is a drawing showing a failure detection signal.

FIG. 6 is a diagram for explaining a failure detection signal. In FIG. 6, the vertical axis represents signal level while the horizontal axis represents time. The output waveform of the failure detection signal is shown on the upper side of FIG. 6, while the time at which the failure detection process is performed is shown in the second row of FIG. 6. The example of FIG. 6 shows the case of the failure detection process being periodically performed at the period T. The failure detection portion 15 performs failure detection at the period T, and upon determining that the audio output device 50 and the audio input device 60 are both normal, inverts the failure detection signal. In the example of FIG. 6, the failure detection process is performed at each time of the times TS1 to TS3, and it is determined that the audio output device 50 and the audio input device 60 are both normal at each time of the times T1 to T3. Then, at each time of the times T1 to T3, the failure detection signal is inverted from the low level to the high level or from the high level to the low level and outputted.

In the example of FIG. 6, the failure detection process is performed at time TS4, but at time T4, since it is determined that at least one of the audio output device 50 or the audio input device 60 is not normal, the failure detection signal is outputted as is at the high level without the failure detection signal (high level) at time T3 being inverted.

As described above, in this embodiment, when the audio input/output module 80 is not operating normally, the failure detection signal is not inverted. That is, inversion (change) of the failure detection signal can indicate that the audio input/output module 80 including at least the failure detection apparatus 10 is operating normally. Further, by causing the failure detection apparatus 10 of the present embodiment to output the failure detection signal as a toggle signal, it is possible to notify the communication module 90 not only whether or not the audio output device 50 and the audio input device 60 are normal, but also whether or not the processor 70 itself is normal.

In addition, the failure detection signal may be output using a plurality of communication paths. Thereby, even when some communication paths cannot perform communication, the communication module 90 may be notified of the failure detection signal through other communication paths, and so a robust configuration can be achieved. For example, a plurality of physical signal sources may be used as communication paths. The communication path for outputting the failure detection signal from the failure detection apparatus 10, and all or some signal lines for outputting the result of failure detection from the failure detection apparatus 10 to the audio processing portion 20 and outputting the transmission sound signal for notification from the audio processing portion 20 to the communication module 90 may be used as communication paths. The communication path used for notification from the audio processing portion 20 to the communication module 90 and the communication path for outputting the failure detection signal from the failure detection apparatus 10 may be used together to output the failure detection result. In the case of causing the failure detection result to be output from the signal line for outputting the transmission sound signal, assuming a configuration that notifies the communication module 90 of the failure detection signal only when the audio output device 50 and the like is not normal, it is possible to more reliably notify the communication module 90 of failure of a device without increasing the number of signal lines.

Figure 7:
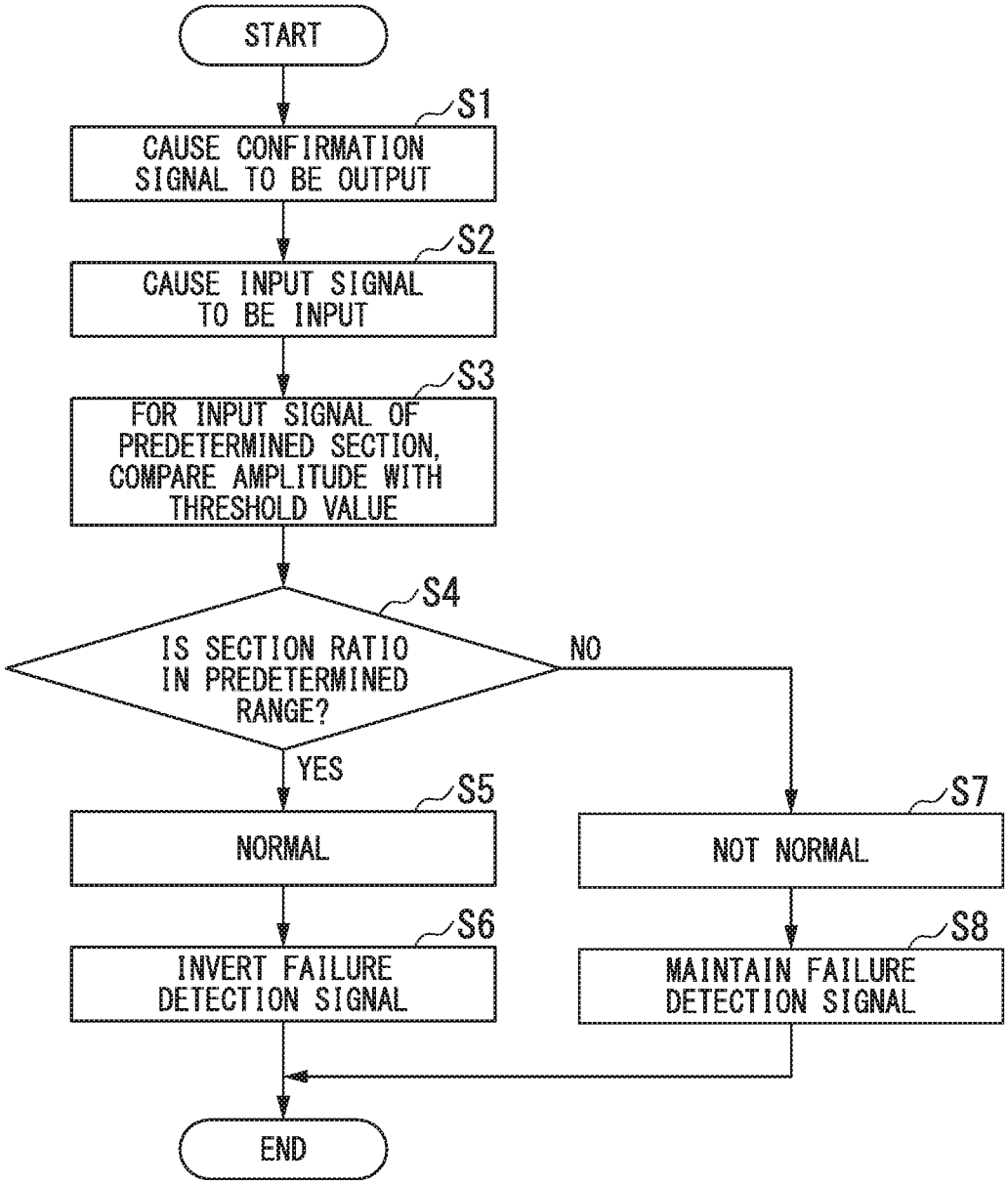
FIG. 7 is a flowchart showing an example of a failure detection process performed by the failure detection apparatus.

FIG. 7 is a flowchart showing an example of the failure detection process. As shown in FIG. 7, when a failure detection timing signal from the timer 11 is input, the failure detection portion 15 outputs a control signal to the signal generation unit 30 to cause a confirmation signal to be output (Step S1). The confirmation signal is output from the audio output device 50 via the adder 40, loops around to the microphones 61 and 62, and is input from the audio input device 60. The failure detection portion 15 inputs the input signal from the audio input device 60 (Step S2). In the input signal that has been inputted, the failure detection portion 15 identifies a section on the basis of the burst period of the confirmation signal and, for the input signal in that predetermined section, compares the amplitude of the input signal and a predetermined threshold value (Step S3). The failure detection portion 15 finds, in the predetermined section that has been identified, the ratio of a section having an amplitude equal to or greater than the predetermined threshold value to the predetermined section (section ratio), and determines whether the section ratio is within a predetermined range (Step S4). If the section ratio is within the predetermined range, the failure detection portion 15 determines that the audio output device 50 and the audio input device 60 are normal (Step S5). Upon making a determination to the effect of being normal, the failure detection portion 15 inverts the signal level of the failure detection signal (Step S6). On the other hand, if the section ratio is outside the predetermined range, the failure detection portion 15 determines that at least either one of the audio output device 50 and the audio input device 60 is not normal (Step S7). Upon making a determination to the effect of not being normal, the failure detection portion 15 does not invert the signal level of the failure detection signal. By doing so, the failure detection signal becomes a high-level or low-level signal (Step S8).

As described above, the failure detection apparatus 10 of the present embodiment is provided with the output portion 12 that causes the confirmation signal configured with a frequency in a band other than the audible band to be output from the audio output device 50, the input portion 13 that receives the input signal from the audio input device 60, and the failure detection portion 15 that detects whether or not both of the audio output device 50 and the audio input device 60 are normal based on the confirmation signal and the input signal, whereby the failure detection apparatus 10 can perform failure detection without emitting a sound having a frequency in the audible band during failure detection.

The failure detection apparatus 10 of the present embodiment is not limited to the constitutions described above, and in order to more accurately perform failure detection, for example, the frequency composing the confirmation signal may be configured to be changeable.

In the present embodiment, regarding the frequency composing the confirmation signal, the frequency of the confirmation signal should at least be configured outside the audible band. For example, the failure detection apparatus 10 may output the confirmation signal so as to change the frequency thereof with the passage of time such that the frequency of the confirmation signal is output in the order of 19 kHz, 20 kHz, and 21 kHz for specific sections.

In this case, at the input portion 13 of the failure detection apparatus 10, failure detection is performed via three types of bandpass filters that cut off frequencies other than each frequency. First, the failure detecting portion 15 determines whether or not a signal is detected in which the section ratio of the input signal passed through a 19 kHz bandpass filter is within the predetermined range, and whether or not a signal is detected in which the section ratio of the input signal passed through 20 kHz and 21 kHz bandpass filters is not within the predetermined range. Next, the failure detection portion 15 determines whether or not a signal is detected in which the section ratio of the input signal passed through a 20 kHz bandpass filter is within the predetermined range, and whether or not a signal is detected in which the section ratio of the input signal passed through 19 kHz and 21 kHz bandpass filters is not within the predetermined range. Moreover, the failure detection portion 15 determines whether or not a signal is detected in which the section ratio of the input signal passed through a 21 kHz bandpass filter is within the predetermined range, and whether or not a signal is detected in which the section ratio of the input signal passed through 19 kHz and 20 kHz bandpass filters is not within the predetermined range. In the case of a signal in which the section ratio is within the predetermined range being detected in the order of 19 kHz, 20 kHz, 21 kHz from the input signal, the failure detection portion 15 may make a determination of normality. In this way, it is possible to perform failure detection more accurately by changing the frequency of the confirmation signal.

Moreover, in the present embodiment, the output level of the confirmation signal is kept constant, but is not limited thereto. For example, a pattern may be repeated such that the output level of the confirmation signal is made to be output at the three levels of high, middle and low. For example, the failure detecting portion 15 compares the input signal with a plurality of threshold values (in this case, assume the three threshold values of threshold value 1, threshold value 2 smaller than threshold value 1, threshold value 3 smaller than threshold value 2).

In this case, first, the failure detection portion 15 confirms the detection of a signal in which the section ratio of a signal greater than the threshold value 1 is within the predetermined range. Next, the failure detection portion 15 confirms the detection of a signal in which the section ratio of a signal greater than the threshold value 1 is not within the predetermined range, and the detection of a signal in which the section ratio of a signal greater than the threshold value 2 is within the predetermined range. Moreover, the failure detection portion 15 confirms the detection of a signal in which the section ratio of a signal greater than the threshold value 2 is not within the predetermined range, and the detection of a signal in which the section ratio of a signal greater than the threshold value 3 is within the predetermined range. In the case of signals being detected in the order described above, the failure detection portion 15 makes a determination of normality.

Further, the failure detection portion may also detect a frequency or the like included in the noise before performing failure detection. Failure detection can be performed more accurately by detecting the state of noise before performing failure detection. For example, when the same frequency as the frequency of the confirmation signal used for failure detection is included in the noise at a certain level or higher, failure detection is not performed until there is a decrease in the level of the frequency included in the noise that is the same as the frequency of the confirmation signal used for failure detection, or the frequency of the confirmation signal is changed so that the frequency included in the noise does not overlap with the frequency of the confirmation signal.

The embodiment described above can be applied to a failure detection apparatus, an audio input/output module, an emergency notification module, and a failure detection method.

What is claimed is:

1. An input/output module comprising:
an audio input device;
an audio output device disposed at a fixed distance relative to the audio input device; and
a failure detection apparatus comprising:
an output interface that outputs to the audio output device a confirmation signal that is a burst signal that:
includes a signal portion and a non-signal portion;
is in a frequency band other than an audible band;
periodically switches, during a period including a signal period that includes the signal portion and a non-signal period that includes the non-signal portion, the signal period to the non-signal period;
includes an envelope that:
gradually increases over time during the signal period; and
gradually decreases over time during the non-signal period; and
has an arbitrary duty ratio of the signal period to the period;
an input interface that receives an input signal from the audio input device; and
a processor configured to execute a failure detection task that detects whether the audio output device and the audio input device are operating normally based on a ratio of a partial time length of a period of the burst signal that includes the signal portion and the non-signal portion where an amplitude thereof is equal to or greater than a predetermined threshold value and an entire time length of the period of the burst signal.

2. The input/output module according to claim 1, wherein the confirmation signal includes a frequency equal to or greater than 16 kHz and equal to or less than 24 kHz.

3. The input/output module according to claim 1, wherein the failure detection task detects whether the audio output device and the audio input device are operating normally based on the input signal that has been passed through a bandpass filter.

4. The audio input/output module according to claim 1, wherein the failure detection task outputs a failure detection signal as a toggle signal when the audio output device and the audio input device are determined to be operating normally.

5. The audio input/output module according to claim 4, wherein the failure detection task outputs the failure detection signal to a communication interface.

6. The audio input/output module according to claim 1, wherein there are the audio input device includes a plurality of audio inputs.

7. The audio input/output module according to claim 6, wherein the failure detection apparatus detects whether or not each of the plurality of audio inputs is operating normally.

8. An emergency notification module comprising:
the audio input/output module according to claim 1; and
a communication interface that receives the input signal input to the audio input device and supplies a sound signal to the audio output device.

9. An input/output module comprising:
an audio input device;
an audio output device disposed at a fixed distance relative to the audio input device; and
a failure detection apparatus comprising:
an output interface that outputs from the audio output device a confirmation signal that is a burst signal that:
includes a signal portion and a non-signal portion;
is in a frequency band other than an audible band; and
includes an envelope that:
changes in shape during a period including a signal period that includes the signal portion and a non-signal period that includes the non-signal portion, including:
gradually increasing over time during the signal period; and
gradually decreasing over time during the non-signal period;
an input interface that receives an input signal from the audio input device; and
a processor configured to execute a failure detection task that detects whether the audio output device and the audio input device are operating normally based on a ratio of a partial time length of a period of the burst signal that includes the signal portion and the non-signal portion where an amplitude thereof is equal to or greater than a predetermined threshold value and an entire time length of the period of the burst signal.

10. A failure detection method for an audio input/output module including an audio input device and an audio output device disposed at a fixed distance relative to the audio input device, the method comprising:
outputting from the audio output device a confirmation signal that is a burst signal that:
includes a signal portion and a non-signal portion;
is in a frequency band other than an audible band;
periodically switches, during a period including a signal period that includes the signal portion and a non-signal period that includes the non-signal portion, the signal period to the non-signal period;
includes an envelope that:
gradually increase over time during the signal period; and
gradually decreases over time during the non-signal period; and
has an arbitrary duty ratio of the signal period to the period;
inputting an input signal from the audio input device; and detecting whether the audio output device and the audio input device are operating normally based on a ratio of a partial time length of a period of the burst signal that includes the signal portion and the non-signal portion where an amplitude thereof is equal to or greater than a predetermined threshold value and an entire time length of the period of the burst signal.

* * * * *